United States Patent [19]

Heyen et al.

[11] Patent Number: 5,030,254

[45] Date of Patent: Jul. 9, 1991

[54] LEAD-PLATE ELECTRIC PRECIPITATOR

[75] Inventors: Peter Heyen, Bad Harzburg; Karl-Heinz Naumann, Goslar; Horst Renneberg, Wolfenbüttel, all of Fed. Rep. of Germany

[73] Assignee: Bleiwerk Goslar GmbH & Co. KG Besserer & Ernst, Goslar, Fed. Rep. of Germany

[21] Appl. No.: 456,385

[22] Filed: Dec. 26, 1989

[30] Foreign Application Priority Data

Jan. 11, 1989 [DE] Fed. Rep. of Germany ..... 3900552
Oct. 17, 1989 [EP] European Pat. Off. ..... 89119212.2

[51] Int. Cl.[5] ..... B03C 3/00

[52] U.S. Cl. ..... 55/151; 55/154; 55/156

[58] Field of Search ..... 55/151, 152, 154, 156, 55/140, 147, 148

[56] References Cited

U.S. PATENT DOCUMENTS 2,853,150 9/1958 Lenehan ..... 55/156
3,831,351 8/1974 Gibbs et al. ..... 55/151
4,441,897 4/1984 Young et al. ..... 55/151

FOREIGN PATENT DOCUMENTS 714589 9/1954 United Kingdom ..... 55/154

*Primary Examiner*—Bernard Nozick
*Attorney, Agent, or Firm*—Herbert Dubno; Andrew Wilford

[57] ABSTRACT

An electric precipitator has a plurality of parallel, longitudinally straight and throughoing, and transversely spaced longitudinal main beams, respective parallel, planar, and transversely spaced longitudinal main plates suspended from the beams, a plurality of parallel and longitudinally spaced cross plates extending generally orthogonally between the main plates and defining corners therewith, and respective oblique webs in the corners and each extending at about 45° from the respective cross plate to the respective main plate. Thus the plates and webs together define octagonal-section passages. Respective electrodes extend centrally in the cells and, due to the octagonal section of these cells, there are no dead corners and, in fact, charge concentration is more uniform than in the hexagonal-section systems.

11 Claims, 6 Drawing Sheets

LEAD-PLATE ELECTRIC PRECIPITATOR

FIELD OF THE INVENTION

The present invention relates to an electrofilter. More particularly this invention concerns an electrostatic precipitator having planar side walls formed of a synthetic-resin or metal, preferably of lead.

BACKGROUND OF THE INVENTION

A standard electrofilter for removing liquid or solid particles from a gas stream comprises a plurality of parallel, longitudinally straight and throughoing, and transversely spaced longitudinal main beams from which are suspended respective parallel and transversely spaced longitudinal main plates. Thus these plates form longitudinally extending and vertically open slots in which are hung longitudinally spaced electrode wires. Opposite charges are applied to the plates and the wires to form a charge zone so that particles in a gas stream normally passed up through these slots become charged and adhere to the surfaces of the plates.

The disadvantage of such an arrangement is that there is relatively little collection surface area. Furthermore the charge density varies greatly, being ample close to the wire electrodes but being quite weak midway between adjacent wires against one side or the other of the slot. Thus such an electrofilter can let pass substantial particles.

It is also known to provide such a filter with a plurality of parallel and longitudinally spaced cross plates that bridge and extending between the main plates at about 90° to define a plurality of square, that is four-sided corners therewith. This increases the surface area for particle collection substantially, but still has dead regions in the corners of the passages where the charge is so very weak that little filtering takes place.

A partial solution to this low-efficiency problem (see German patent documents 1,001,240 and 2,641,114) is the use of a honeycomb arrangement, that is one where the passages are hexagonal in section. In such an arrangement the charge concentration remains high even in the six corners of the passages, but several other problems exist. Principally the problem is that such a structure requires that adjacent passage be staggered with one another if both faces of the passage-defining plates are to be used for particle collection. Thus in and arrangement where both faces of the wall-defining plates are used as collection surfaces thesee walls must deflect back and forth at 120° so that they and their supporting beams cannot be straight. As a result it is impossible to make them as strong as straight beams and planar plates. Since it is standard to make these walls of a lead-coated steel or synthetic resin, or even of solid lead to avoid corrosion when the system is used in a wet-scrubbing system to get rid of sulfur compounds, these wall plates are very heavy. The only solution in the honeycomb arrangement is therefore to align the passages with one another, in which case a large percentage of the usable surface area becomes unusable dead space for a significant and normally intolerable loss in efficiency due in part to the presence of all this dead space and in part to not using both faces of the passage-defining plates.

OBJECTS OF THE INVENTION

It is therefore an object of the present invention to provide an improved electrofilter.

Another object is the provision of such an improved electrofilter which overcomes the above-given disadvantages, that is which uses substantially all surfaces of the passage-defining plates, which uses strong planar plates, and which also has relatively little dead space.

SUMMARY OF THE INVENTION

An electrofilter according to the invention has a plurality of parallel, longitudinally straight and throughoing, and transversely spaced longitudinal main beams, respective parallel, planar, and transversely spaced longitudinal main plates suspended from the beams, a plurality of parallel and longitudinally spaced cross plates extending generally orthogonally between the main plates and defining corners therewith, and respective oblique webs in the corners and each extending at about 45° from the respective cross plate to the respective main plate. Thus the plates and webs together define octagonal-section passages. Respective electrodes extend centrally in the cells and, due to the octagonal section of these cells, there are no dead corners and, in fact, charge concentration is more uniform than in the hexagonal-section systems.

With this system, therefore, extremely strong straight beams and planar plates can be used, while at the same time little space is lost in the passage corners behind the webs. In fact when the passages are of regular octagonal section only about 17% of the total cross-sectional area of the electrofilter is lost to these blocked corner areas. In addition both faces of four of the eight walls of each passage are used so that the system is quite efficient.

According to another feature of this invention respective parallel and longitudinally spaced cross beams have ends supported on the main beam and carry the respective cross plates. Furthermore the cross beams have triangular gussets at the corners joined to the respective webs so that spaces defined behind the webs are blocked by the gussets.

These cross plates and respective webs can be integral and formed as a double Y. The double-Y cross plates and webs have arms extending at about 135° to each other.

In another arrangement according to the invention the webs are formed by angle irons having legs fixed to the main plates and corners between which the cross plates extend. These legs extend at about 90° to each other and respective parallel, transersely throughgoing, and longitudinally spaced cross beams have ends supported on the main beam and carrying the respective cross plates. Furthermore the corners of the angle irons form grooves into which the cross plates fit slidably. This makes these cross plates removable for extremely easy cleaning or repair of the filter.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to on figure but identical to those of another refer to structure that is functionally if not structurally identical. In the accompanying drawing.

SPECIFIC DESCRIPTION

Figure 1:
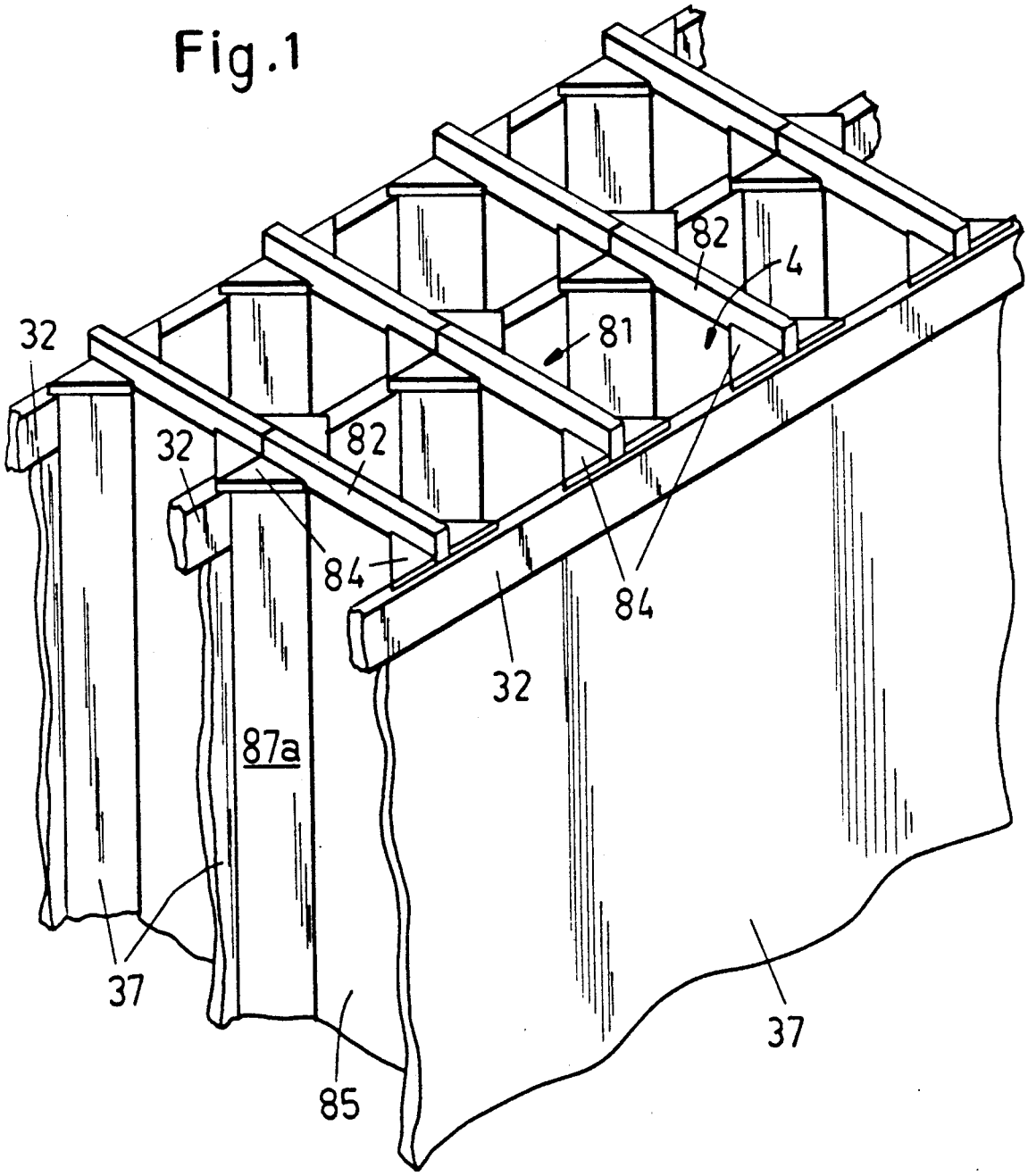
FIG. 1 is a perspective view of the electrofilter according to this invention.

As seen in FIGS. 1 through 4 an electrofilter according to this invention is basically formed by a plurality of identical, lead plated, and inverted U-section main beams 32 from which are suspended lead plates 37 that all extend longitudinally parallel to one another in vertical planes spaced transversely from one another. Bridging these beams 32 are crosspieces 81 (FIG. 3) from which are suspended cross plates 83 (FIGS. 3 and 4) Together the plates 37 and 83 define octagonal-section vertical passages 4 having side surfaces 80*a* through 80*h* of the same size. Extending centrally up the center of each such passage 4 is an electrode wire 21 connected to one pole of a power supply 22 whose other pole is connected to the network of plates 32 and 83 to form a field indicated at 23.

Figure 3:
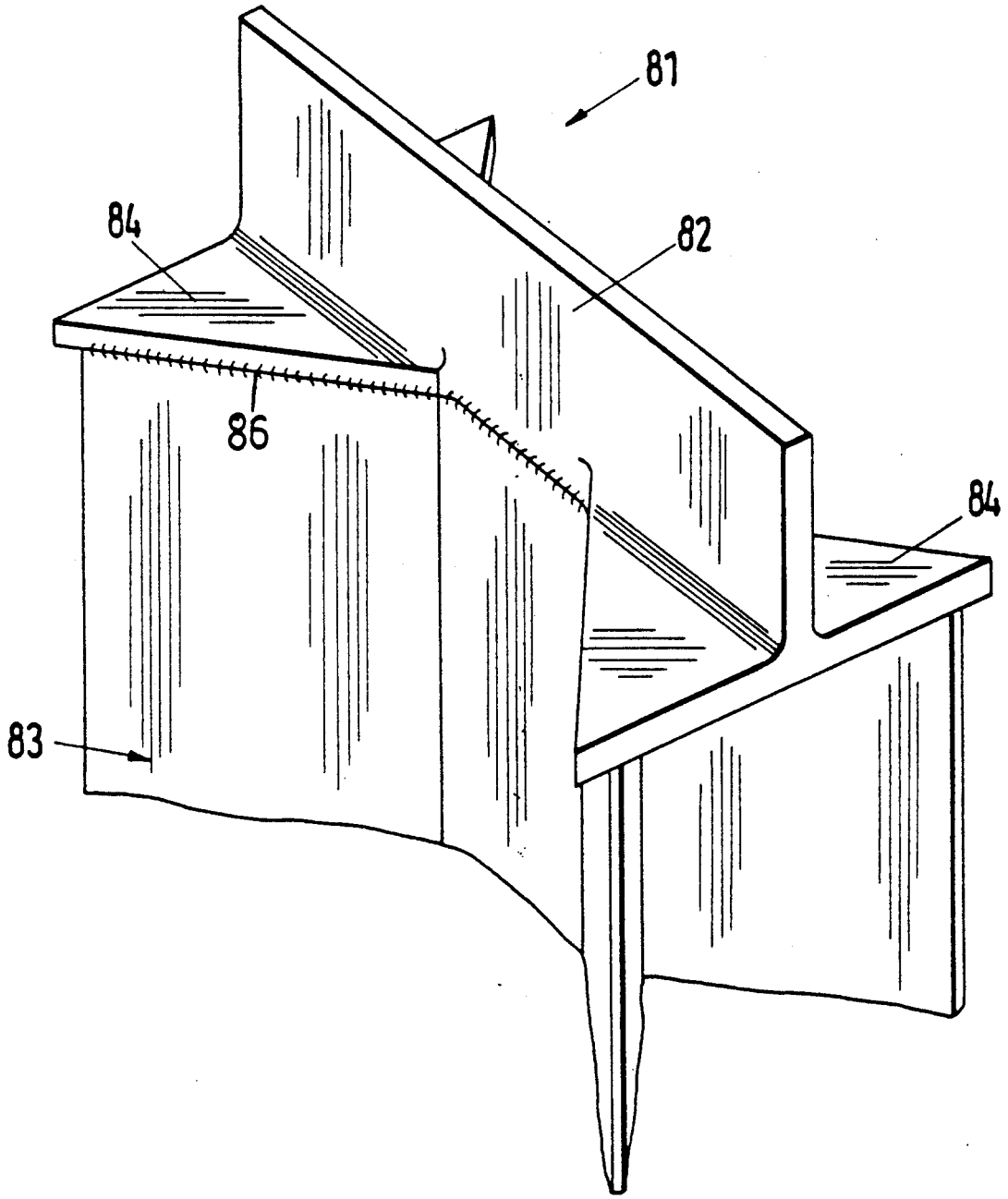
FIG. 3 is a perspectitive large-scale view of a detail of FIG. 1.
Figure 4:
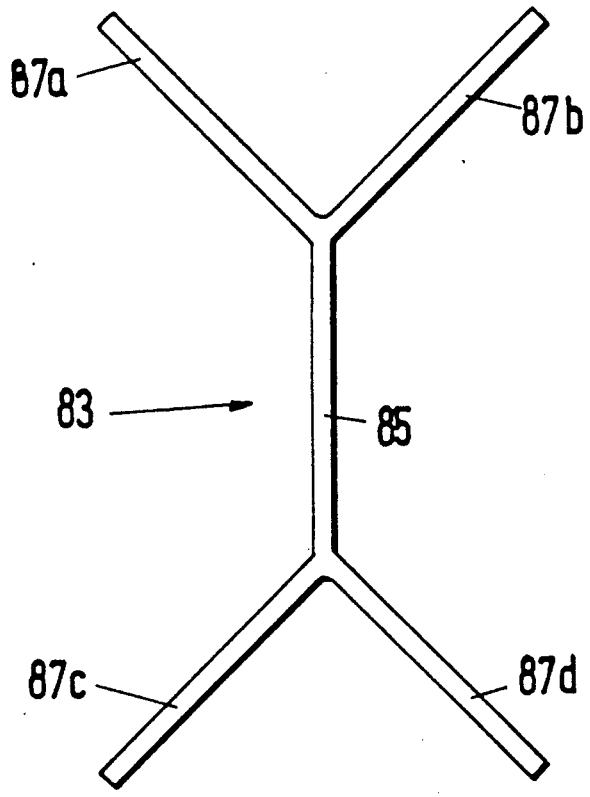
FIG. 4 is a top view of a partition of the system of FIGS. 1 through 3.

As seen in FIG. 3 each crosspiece 81 comprises a rigid lead-coated cross beam 82 having four triangular gusset plates 84 that serve to cover the corner spaces surrounding each passage 4. Each cross plate as seen in FIG. 4 is of double-Y shape, that is shaped like two Y's one of which is inverted and has its leg joined to the other. Thus each cross plate 83 comprises a central leg plate 85 from one edge of which extend two arms 87*a* and 87*b* and from the opposite edge of which extend two further such arms 87*c* and 87*d*. Each of the arms 87*a* and 87*c* forms an angle of 90° with the other respective arm 87*b* and 87*d*, so that these arms 87*a* through 87*d* lie at angles of 135° to the leg part 85. The upper edges of these parts 85 and 87*a* through 87*d* are secured by welds 86 (FIG. 3) to the outer edges of the cross beam 87 and the gusset plates 84.

Figure 2:
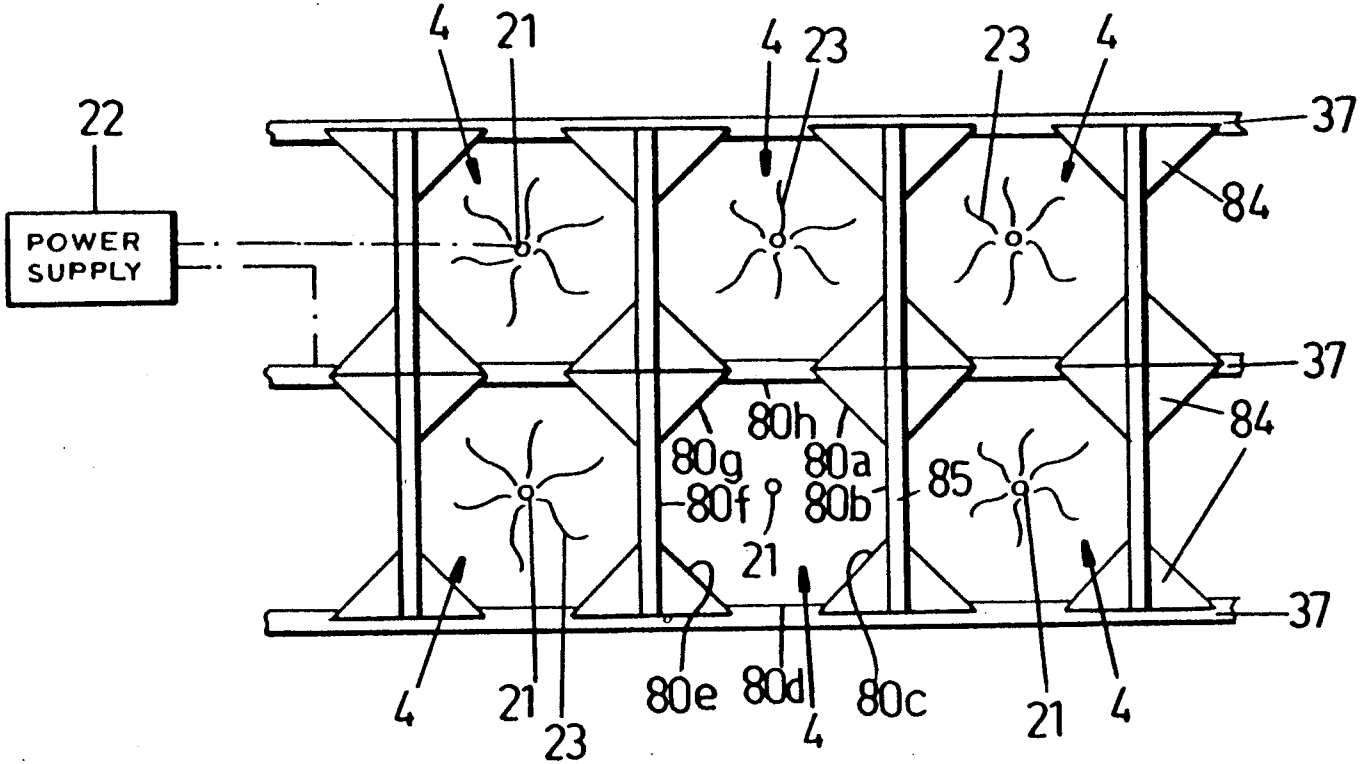
FIG. 2 is a top view of the filter of FIG. 1 showint it in various states of construction.
Figure 5:
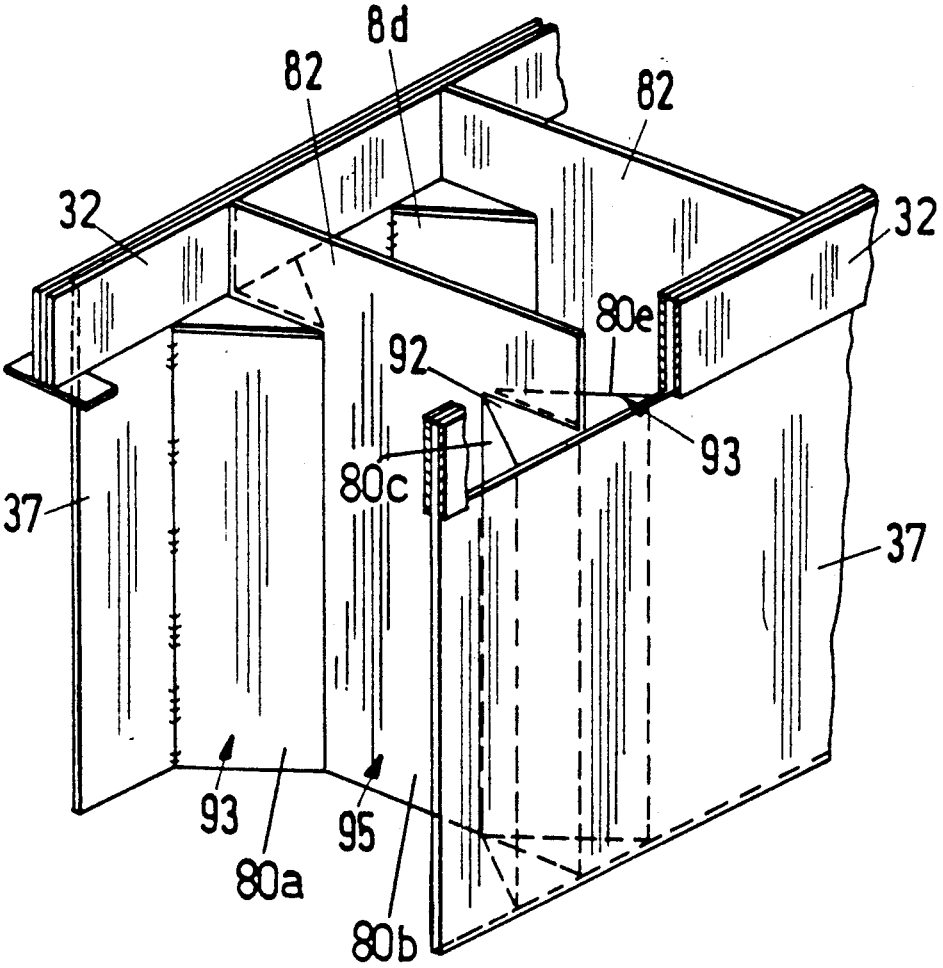
FIG. 5 is a perspective view of another arrangement according to this invention.
Figure 7:
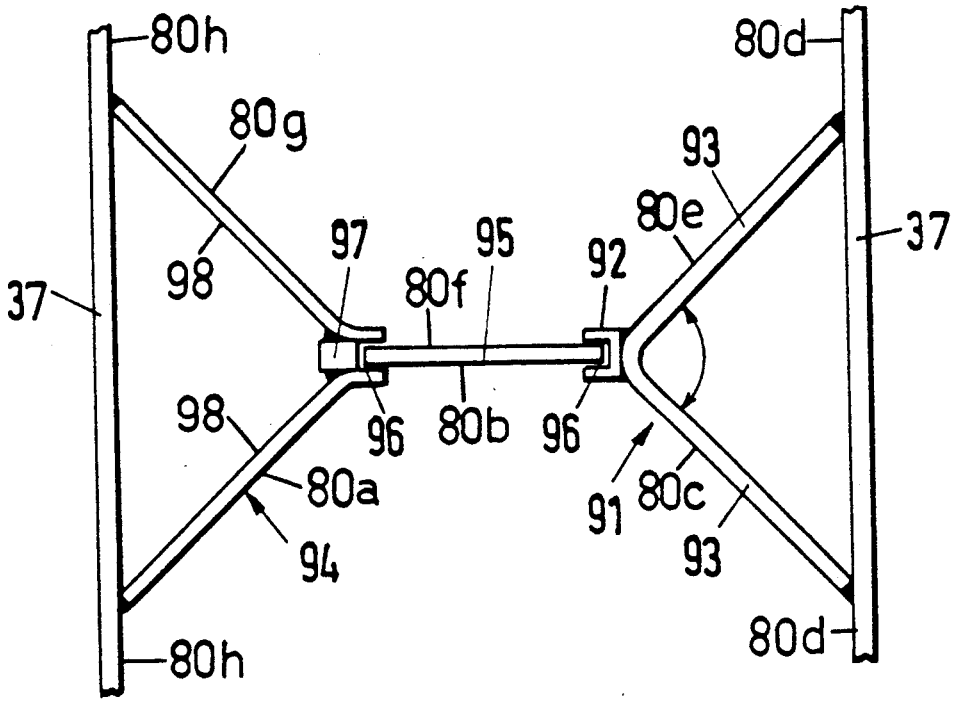
FIG. 7 is a side view of a partition plate for the system of FIG. 5 and 6.
Figure 6:
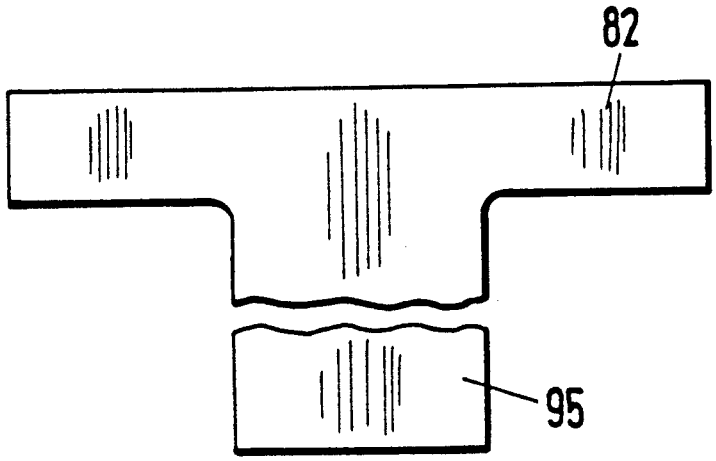
FIG. 6 is a top view of a detail of FIG. 5.

In the arrangement of FIGS. 4 and 5 the beams 32 and plates 37 are identical to those of FIGS. 1 through 3. Here, however, angle elements 91 and 94 define the respective surfaces 80*a*, 80*c*, 80*e*, and 80*g*. The angle element 91 is a one-piece angle iron having legs 93 welded to the respective plate 37 and a channel 92 welded to its corner and forming a seat 96. The angle element 94 is formed by two independent plates 98 having outer edges welded to the respective plate 37 and inner edges sandwiching a spacer bar 97 to form another groove seat 96 confronting the seat 96 of the angle iron 91. A plate 95 integrally formed with the respective beam 82 can slide down in the two seats 96 so that removal of this plate 95 to clean the electrofilter is quite easy.

We claim:

1. An electric precipitator comprising:
   a plurality of parallel, longitudinally straight and throughgoing, and transversely spaced longitudinal main beams;
   respective parallel and transversely spaced longitudinal main plates suspended from the beams;
   a plurality of parallel and longitudinally spaced cross plates extending between the main plates at about 90° and defining corners therewith;
   respective oblique webs in the corners and each extending at about 45° from the respective cross plate to the respective main plate, whereby the plates and webs together define octagonal-section passages; and
   respective electrodes extending centrally in the passages.

2. The electric precipitator defined in claim 1 wherein the passages are of regular octagonal section.

3. The electric precipitator defined in claim 1 wherein the plates and beams are at least formed on their surfaces of lead.

4. The electric precipitator defined in claim 1, further comprising
   respective parallel and longitudinally spaced cross beams having ends supported on the main beam and carrying the respective cross plates.

5. The electric precipitator defined in claim 4 wherein the cross beams have triangular gussets at the corners joined to the respective webs, whereby spaces defined behind the webs are blocked by the gussets.

6. The electric precipitator defined in claim 1 wherein the cross plates and respective webs are integral and are formed as a double Y.

7. The electric precipitator defined in claim 6 wherein the double-Y cross plates and webs have arms extending at about 135° to each other.

8. The electric precipitator defined in claim 1 wherein the webs are formed by angle irons having legs fixed to the main plates and corners between which the cross plates extend.

9. The electric precipitator defined in claim 8 wherein the corners of the angle irons form grooves into which the cross plates fit slidably.

10. The electric precipitator defined in claim 8 wherein the legs extend at about 90° to each other.

11. The electric precipitator defined in claim 10, further comprising
   respective parallel, transersely throughgoing, and longitudinally spaced cross beams having ends supported on the main beam and carrying the respective cross plates.

* * * * *